United States Patent [19]

Mann

[11] 4,078,346

[45] Mar. 14, 1978

[54] EARTH COVERED MULTI-STORY RESIDENTIAL BUILDING

[76] Inventor: Harald Mann, Rainerstrasse 5, A-5021 Salzburg, Austria

[21] Appl. No.: 704,093

[22] Filed: Jul. 9, 1976

Related U.S. Application Data

[63] Continuation-in-part of Ser. No. 485,583, Jul. 3, 1974.

[30] Foreign Application Priority Data

Jul. 3, 1973 Austria ..... 5862/73
Jul. 9, 1975 Austria ..... 5316/75

[51] Int. Cl.[2] ..... E02D 29/00
[52] U.S. Cl. ..... 52/169.4; 52/169.6
[58] Field of Search ..... 52/169 R, 169 DT, 169.4, 52/169.6

[56] References Cited

U.S. PATENT DOCUMENTS

| | | | |
|---|---|---|---|
| 744,199 | 11/1903 | Hubbell | 52/169 X |
| 2,241,830 | 5/1941 | Tourtellotte | 52/169 |
| 2,346,196 | 4/1944 | Starret | 52/169 X |

*Primary Examiner*—J. Karl Bell
*Attorney, Agent, or Firm*—Wenderoth, Lind & Ponack

[57] ABSTRACT

A building has plural stories and is at least partially covered by an earth covering. The building has at least one wall of windows not covered. A tunnel providing a vehicular road may extend through the earth covering and building. A ventilation shaft may extend from the tunnel upwardly through the earth covering.

6 Claims, 9 Drawing Figures

EARTH COVERED MULTI-STORY RESIDENTIAL BUILDING

This is a continuation-in-part of application Ser. No. 485,583, filed July 3, 1974.

BACKGROUND OF THE INVENTION

The present invention relates to a building, particularly designed for protection against bombs and radiation, which has a plurality of floors and at least one wall of windows, the ceilings of the various floors being supported by a supporting framework and the top floor being covered with an earth covering.

The problem has been posed to provide every living room or space used, in contrast with the strictly stone and concrete structures of present towns, with a vegetational space of substantially the same size having a biologically protective effect against contamination of the environment.

SUMMARY OF THE INVENTION

This problem is resolved according to the invention in that an earth covering which covers all floors of the building stretches from the cover of the top floor over at least one wall of the building in a sloping manner from the height of the building down to the natural ground level and is provided with exits accessible from the floors.

The building according to the invention differs from bunkers inasmuch as it is only partially covered with earth and has at least one wall of windows. The building of the invention is, however, a permanently used living unit and not a completely covered off installation, such as a bunker, used only in emergencies.

The earth covering of the building according to the invention which leaves free at least one wall of windows is arranged in the form of at least partially sloped surfaces so that hills are formed which can be planted with grass, bushes or trees. In any case the covering must be thick enough that also relatively large trees can grow thereon. It is therefore advantageous if the earth covering which can also consist of purified refuse material is covered with a layer of vegetable soil.

Furthermore it is advantageous if exits accessible from the floors lead to the covered slope. It is particularly advantageous to provide communication tunnels extending horizontally with respect to the walkable slope. As the slopes are only slightly inclined it is possible to reach the ground level from each floor without difficulty by passing through the communication tunnels. This would be an ideal passage for escape in case of fire or other catastrophe in the interior of the building. The conventional automatic extending ladder and the jumping sheet, the only usual possibilities of escape left if staircases and lifts are unusable, are not necessary for the building according to the invention, as one can get to the open from each floor through the communication tunnels.

With regard to civilian air defense and protection against radiation it is suggested according to an additional advantageous characteristic feature of the invention to construct on each floor within the earth covering at least one room having gas-, radiation- and detonation-proof walls and doors. It is convenient if such room lies closer to a covered wall of the building and communicates with the tunnel through a specially shaped door. In an emergency the users or inhabitants of the floor could retire to this protective room and could also escape through the tunnel.

If the building is arranged on a natural or artificial slope the rooms with the wall of windows advantageously project from the slope whereas the protective rooms extend into the slope.

According to another construction it is also possible to protect the whole building or essential parts thereof against radiation fall-out. To protect the window surfaces against radiation it is suitable to erect a further wall in front of the at least one wall of windows extending from the ground to the height of the ridge. This second wall may be provided with loggia-like recesses which in an emergency can be closed by roller blinds or the like. The space between the two walls can be used as a balcony etc.

BRIEF DESCRIPTION OF THE DRAWINGS

Buildings according to the invention will be described in detail with reference to the drawings, although it is not intended that the invention be restricted to these examples.

DETAILED DESCRIPTION OF THE INVENTION

Figure 1:
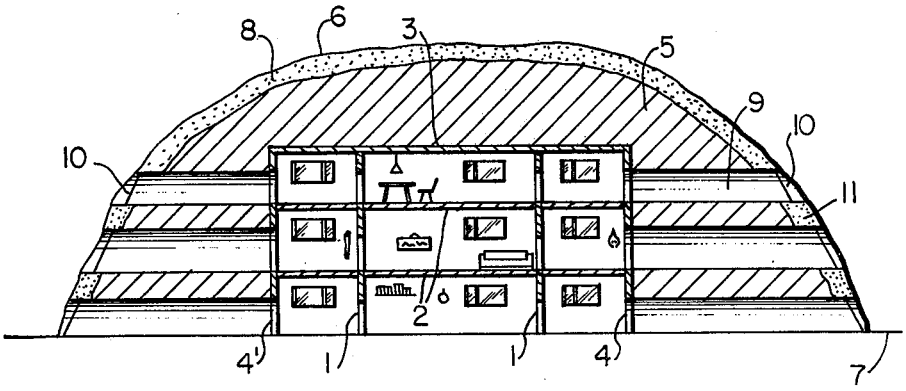
FIG. 1 is a diagrammatic sectional view of a building with an earth covering and layer of vegetable soil according to a first embodiment of the invention.

It will be apparent from FIG. 1, illustrating a first embodiment of the invention, that the building is constructed by floors or stories. The ceilings of the different floors are supported on supporting framework 1. The top floor is covered by an earth covering 5 with a layer of vegetation supporting soil 8 applied thereover. The earth covering, which should be thick enough to be able to plant trees thereon, extends from the height of the ridge 6 and slightly slopes down to natural ground level 7.

From opposite sides or ends of each floor a tunnel 9 leads horizontally through the earth covering and with exit 10 thereof opens to walkable slope 11 which slopes down to the ground level.

Figure 2:
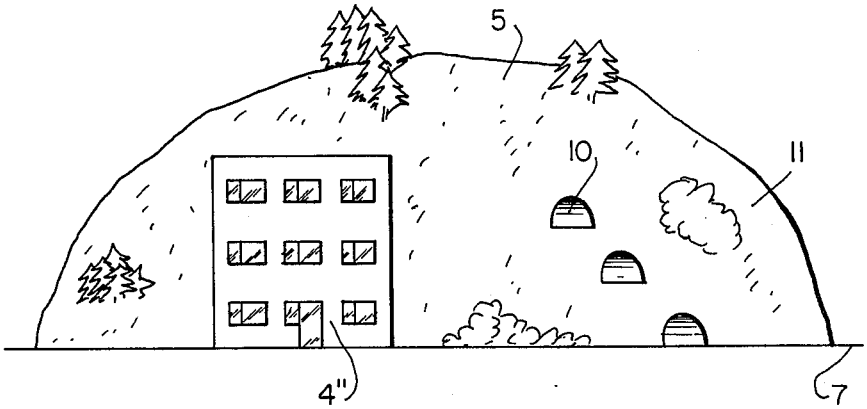
FIG. 2 is a front view showing the vertical front wall of windows and the walkable hill with the tunnel exits of the building of FIG. 1.

FIG. 2 shows front wall 4'' of windows of the building 3. The rest of the building is covered with earth covering 5.

Figure 3:
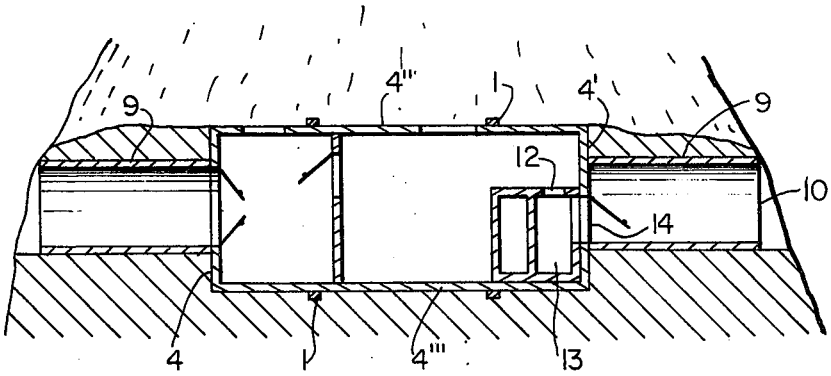
FIG. 3 is a diagrammatic sectional plan view of a floor of the building of FIG. 1.

FIG. 3 shows the construction of a protective room on one floor. The protective room 13 is enclosed by accordingly strong walls 12 and has a supply unit of its own, for instance, of water, light and ventilation. The protective room communicates with tunnel 9 through a shielded door 14. It is desirable to arrange protective room 13 close to a covered wall 4''' of the building and not close to the front wall 4'' of windows.

Figure 4:
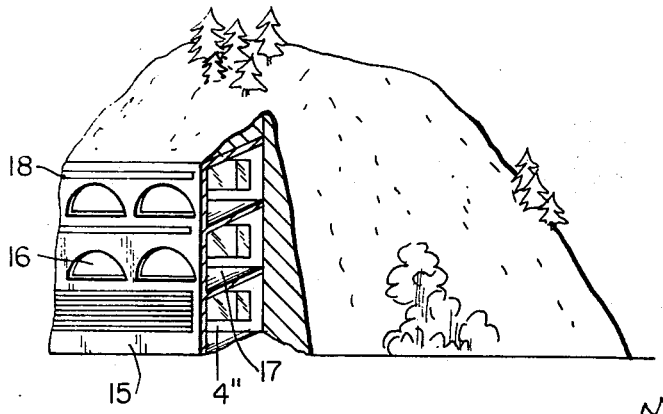
FIG. 4 is a diagrammatic perspective view of a protective wall in front of the front wall of windows of the embodiment of FIG. 1.

FIG. 4 shows a further feature of the invention in which a further wall 15 is erected in front of the front wall 4'' of windows. Wall 15 has therein loggia-like recesses 16 which can be covered by radiation-proof roller blinds 18 or the like. In normal situations the space between wall 15 and the front wall 4'' of windows can be used as a balcony 17.

The advantages of the building according to the first embodiment of the invention are evident. The roofs are replaced by large green areas providing oxygen which areas can also be arranged in the form of recreation areas and play grounds. The planted slopes which have an inclination of about 20% to 30% are used for skiing and tobogganing in winter and for walking in summer. As the green areas arranged at the height of the ridge are far away from the street which leads along the ground level they are scarcely troubled by noise or dirt.

The fact that bunker-like rooms are planned within these residential buildings and that in special cases also the front walls of windows can be safely shielded against radiation is of particular importance in the atomic age.

The heat loss resulting from the heating of the buildings may at least partially be used for warming the vegetation layer covering the building. As the vegetation is appreciated as a factor for protection of the environment, the growth of the gree areas may possibly be maintained during the colder seasons.

Figure 5:
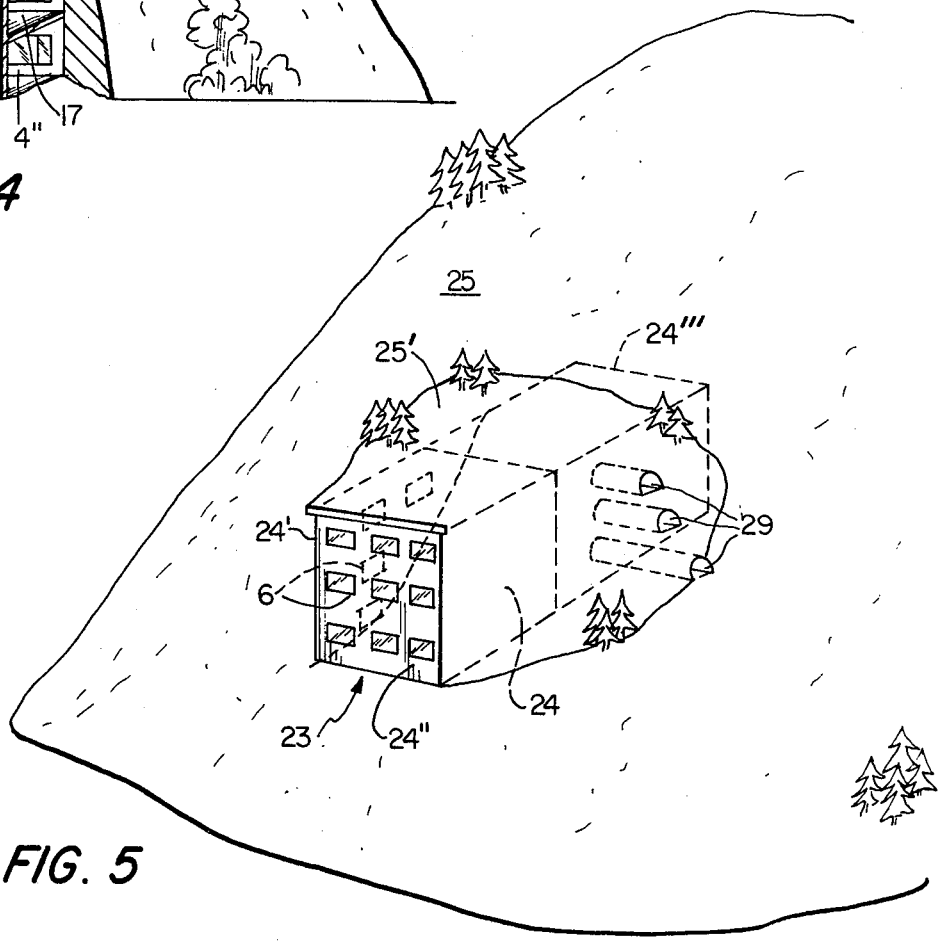
FIG. 5 is a perspective view of a building according to a second embodiment of the invention, wherein the natural slope of hill is supplemented by an additional earth covering to cover the building, or at least a portion thereof.

FIG. 5 illustrates a second embodiment of the residential multi-story building of the present invention. The building of FIG. 5 is similar to the building of FIG. 1. However, in the embodiment of FIG. 5, a portion of the building 23 extends into a naturally occurring hill or slope 25. The remainder of the length or depth wise dimension of the building 23 is covered by a supplemental earth covering 25'. The entire top or roof of the building 23 is covered, either by the naturally occurring earth covering 25 or the supplemental earth covering 25'. One side wall 24, as well as rear wall 24''' are completely covered by earth. Front wall 24'' is entirely exposed in a manner similar to wall 4'' of the embodiment of FIG. 1. Additionally, in the embodiment of FIG. 5 of the invention, it is possible for one side wall 24' to be partially exposed, and the exposed portion may have windows therein. The embodiment of FIG. 5 has tunnels 29 extending from each story to the exterior of the slope of covering 25', in a manner similar to tunnels 9 of the embodiment of FIG. 1.

The embodiment of FIG. 5 may also be supplied with additional features disclosed in the embodiment of FIG. 1, such as wall 15 and protective room or rooms 13.

Figure 6:
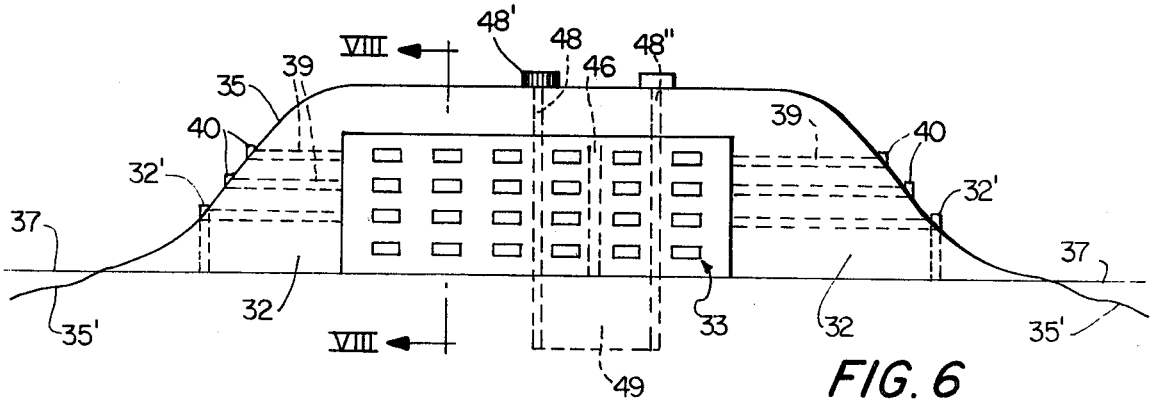
FIG. 6 is a side view of a building according to a third embodiment of the invention.
Figure 7:
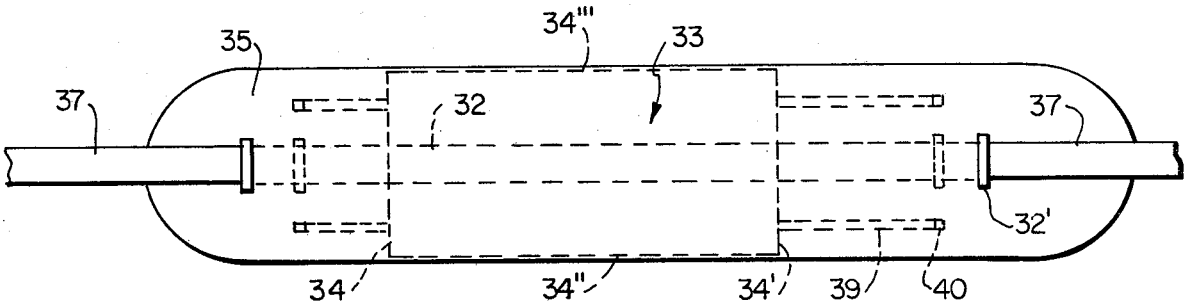
FIG. 7 is a plan view of the building of FIG. 6.
Figure 8:
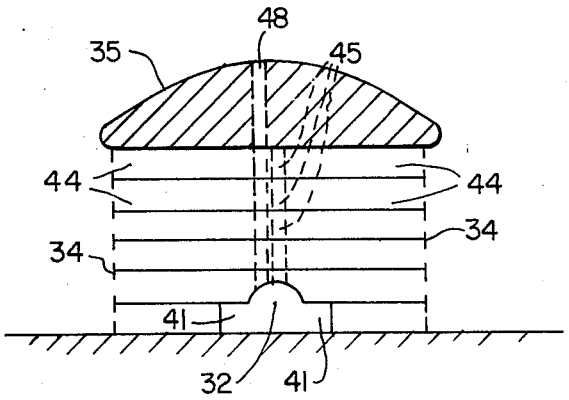
FIG. 8 is a partially schematic section taken along line VIII—VIII in FIG. 6.

FIGS. 6–8 illustrate a still further, third embodiment of the residential multi-story building of the present invention. In this embodiment, a building 33 is covered by an earth covering 35 which completes and complements a naturally occurring ground slope 35'. Building 33 is elongated and multi-storied and has two opposite end walls 34 and 34' entirely covered by earth covering 35. However, in this embodiment of the invention two walls 34'' and 34''' are uncovered and exposed and advantageously may have windows therein.

An additional advantageous feature of this embodiment of the present invention is that the entire building 33 and earth covering 35 has extending therethrough a longitudinal tunnel 32 which provides access for a vehicular road 37. The tunnel 32 acts as an outlet for the lower story or stories, in a manner similar to tunnels 9 of the embodiment of FIG. 1. Reference numerals 32' illustrate the entrances to tunnel 32.

The remainder of the stories, other than those having access to tunnel 32, have extending therefrom tunnels 39 having entrances 40 in a manner similar to tunnels 9 and entrances 10 of the embodiment of FIG. 1. Tunnels 39 and entrances 40 may be locked and provided with bomb and radiation-proof rooms such as those 13 in the embodiment of FIG. 1. Furthermore, walls 34'' and 34''' may be provided with walls similar to those of 15 of the embodiment of FIG. 1.

As shown in FIG. 8, tunnel 32 may be widened as at 41 to provide parking space within the building 33 adjacent the road 37. Preferably, the road 37 is made as wide as desirable to provide a desired number of driving lanes.

FIG. 8 also illustrates that each floor or story of the building 33 has corridors 45 which separate and extend along residential living units 44. Corridors 45 lead toward tunnels 39. Desirably, the rooms within the building which are actually used as living quarters are arranged adjacent the exposed walls 34'' and 34''', whereas those rooms which do not require daylight, such as bathrooms and storage rooms, are arranged toward the interior of the building. Advantageously, radiation-proof and lockable walls, similar to 12 and 13 of the embodiment of FIG. 1, may be provided between the more exterior exposed rooms and the interior rooms.

A further advantageous feature of this embodiment of the present invention is the provision of a ventilation duct 48 extending upwardly through the building and through the earth covering 35 above the roof of the building. Ventilation duct 48 provides an exhaust duct from tunnel 32 and parking spaces 41. The top of duct 48 may be provided with a ventilation and purification device 48' to avoid damage to vegetation on the top of earth covering 35 by the exhausted air. The building 33 is also provided with a large vertical shaft 46 which is accessible from every individual floor or story and which may contain a staircase, an elevator system, and emergency ladders which may be employed when the elevator system is inoperable. Shaft 46 also preferably leads down into underground stories 49 of the building which may be used as specially protected shelters in case of emergency. Duct 48 may advantageously also lead down into underground stories 49. Further advantageously, the building may be provided with additional ventilation ducts 48'' as desired.

Figure 9:
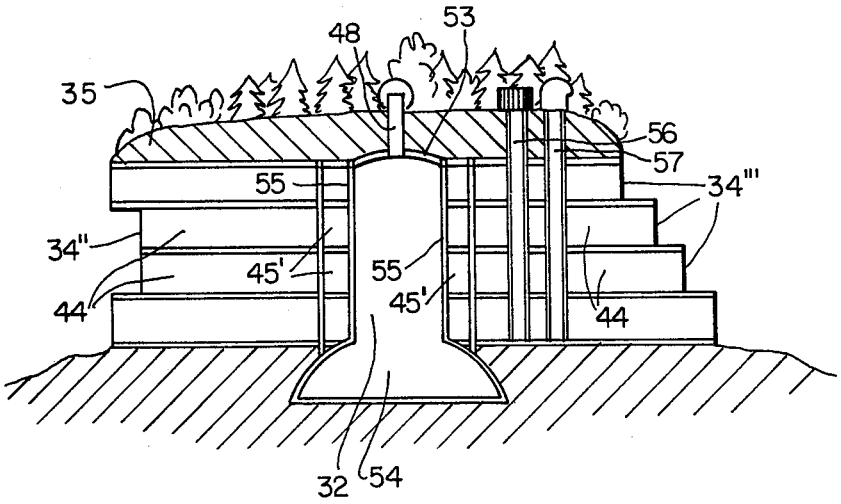
FIG. 9 is a sectional view of a modification of the building of FIG. 6.

FIG. 9 illustrates a cross-sectional view similar to FIG. 8 but of a modification of the third embodiment of the present invention. In this arrangement the lateral dimensions of the various stories may be somewhat irregular as shown in FIG. 9. Furthermore, tunnel 32 extends upwardly throughout substantially the entire height of the building. Furthermore, tunnel 32 extends downwardly into underground stories of the building to provide additional parking space 54. Walls 55 of tunnel 32 define corridors 45' which are on both sides of tunnel 32 and which extend longitudinally through the building. Ventilation shaft 48 extends from the top of tunnel 32 upwardly through the earth covering 35. The top of tunnel 32 may be reinforced as by wall 53. Additional shafts 56 and 57 may be provided as desired for ventilation purposes of for the purpose of providing elements similar to those employed in shaft 46 of FIG. 6.

It will be apparent to those skilled in the art that the embodiment of FIGS. 6–9 need not be built in the precise rectangular manner illustrated therein. Rather, other shaped buildings may be built in accordance with this embodiment of the invention.

It will be further apparent that other various modifications and changes to the above specifically described structural arrangements may be made without departing from the scope of the present invention.

What is claimed is:

1. A multi-storied residential building comprising:

a plurality of stories, all of said stories being vertically aligned such that the uppermost story is positioned vertically above the lowermost story, each said story having therein permanent living quarters and radiation-proof and bomb-proof protective rooms communicating with said permanent living quarters, said building having a roof, a front wall with windows therein, a rear wall and side walls, each of said walls extending vertically throughout the entire height of all of said stories;

all of said stories of said building extending at least partially into the slope of a naturally occurring hill, said naturally occurring hill completely covering said rear wall and covering at least a portion of said roof and said side walls;

a supplemental earth covering joining said hill and completely covering that portion of said roof not covered by said naturally occurring hill, said supplemental covering further covering that portion of at least one of said side walls which is not covered by said naturally occurring hill;

those portions of each of said stories having therein said protective rooms being covered by said earth covering;

said front wall being completely uncovered; and tunnels extending from each of said stories through said earth covering.

2. A multi-storied residential building comprising:

a plurality of stories each having therein permanent living quarters, all of said stories being vertically aligned such that the uppermost story is positioned vertically above the lowermost story;

said building having a first pair of opposite side walls having windows therein;

an earth covering entirely covering the roof of the building and a second pair of opposite side walls thereof, said earth covering forming a slope, said first pair of walls not being covered by said earth covering;

a main tunnel extending completely through said earth covering and said building in a direction substantially parallel to said first pair of walls, said main tunnel including means for radiation-proof and bomb-proof closing the same, said main tunnel having a vehicular road extending completely therethrough;

secondary tunnels extending from all but the lowermost of said stories through said earth covering; and at least one air exhaust shaft extending upwardly from said main tunnel through said earth covering.

3. A building as claimed in claim 2, further comprising underground floors beneath said building, and a shaft extending from said underground floors upwardly through said building to the uppermost story thereof, said shaft comprising means for the installation therein of an elevator, a staircase and a rescue ladder.

4. A building as claimed in claim 2, wherein said main tunnel extends upwardly throughout the entire height of said building.

5. A building as claimed in claim 4, further comprising, at opposite sides of said main tunnel, corridors extending along each of said stories of said building, said corridors separating said main tunnel from said living quarters.

6. A building as claimed in claim 2, wherein said main tunnel is widened at the lowermost portions thereof, thereby providing parking areas within said building.

* * * * *